US009790752B2

(12) United States Patent
Gustavsson

(10) Patent No.: US 9,790,752 B2
(45) Date of Patent: Oct. 17, 2017

(54) HANDLING DEVICE AND METHOD FOR HANDLING DRILL STRING COMPONENTS IN ROCK DRILLING AND ROCK DRILL RIG

(71) Applicant: ATLAS COPCO CRAELIUS AB, Märsta (SE)

(72) Inventor: Rickard Gustavsson, Upplands Väsby (SE)

(73) Assignee: ATLAS COPCO CRAELIUS AB, Märsta (SE)

( * ) Notice: Subject to any disclaimer, the term of this patent is extended or adjusted under 35 U.S.C. 154(b) by 241 days.

(21) Appl. No.: 14/407,797

(22) PCT Filed: Jun. 25, 2013

(86) PCT No.: PCT/SE2013/050761
§ 371 (c)(1),
(2) Date: Dec. 12, 2014

(87) PCT Pub. No.: WO2014/003647
PCT Pub. Date: Jan. 3, 2014

(65) Prior Publication Data

US 2015/0144402 A1 May 28, 2015

(30) Foreign Application Priority Data

Jun. 28, 2012 (SE) ..... 1250728

(51) Int. Cl.
*E21B 19/15* (2006.01)
*E21B 19/20* (2006.01)

(52) U.S. Cl.
CPC ..... *E21B 19/155* (2013.01); *E21B 19/20* (2013.01)

(58) Field of Classification Search
CPC ..... E21B 19/20; E21B 19/155; E21B 19/08; E21B 19/087; E21B 19/083
See application file for complete search history.

(56) References Cited

U.S. PATENT DOCUMENTS 3,682,259 A 8/1972 Cintract et al.
3,706,347 A 12/1972 Brown
(Continued)

FOREIGN PATENT DOCUMENTS

GB 2047306 A 11/1980
WO WO-01/33034 A1 5/2001
WO WO-2005/073497 A1 8/2005

OTHER PUBLICATIONS

PCT/ISA/210—International Search Report—dated Nov. 13, 2013 (Issued in PCT/SE2013/050761).
(Continued)

*Primary Examiner* — Jennifer H Gay
(74) *Attorney, Agent, or Firm* — Venable LLP; Jeffri A. Kaminski

(57) ABSTRACT

A handling device for handling drill string components with respect to a rock drill rig including a rotator device supported on a feed beam and arranged to rotate and drive a drill string component. A gripper grips drill string components. The gripper is swingably supported around a first swing axis between: a first position aligned with the active drill string position, and a second position aligned with a delivering position for drill string components. A swing arm includes a support configured to support a drill string component and is swingable around a second swing axis. A guiding beam is fastenable at end regions in connection with respective regions of the first and second swing axis. The guiding beam forms mechanical stops for the gripper in the second position and for the swing arm in the delivering position. Also, a rock drill rig and a method.

19 Claims, 8 Drawing Sheets

(56) References Cited

U.S. PATENT DOCUMENTS 4,235,566 A * 11/1980 Beeman ..... E21B 19/155 175/85
4,347,028 A * 8/1982 Dugan ..... E21B 19/155 414/22.61
4,380,297 A 4/1983 Frias
4,386,883 A * 6/1983 Hogan ..... E21B 19/155 414/22.61
4,403,898 A 9/1983 Thompson
4,547,109 A 10/1985 Young et al.
4,822,230 A * 4/1989 Slettedal ..... E21B 19/155 175/85
4,832,552 A 5/1989 Skelly
6,695,559 B1 2/2004 Pietras
6,854,520 B1 2/2005 Robichaux
7,090,035 B2 * 8/2006 Lesko ..... E21B 19/20 175/113
7,832,974 B2 11/2010 Fikowski et al.
7,992,646 B2 * 8/2011 Wright ..... E21B 19/155 166/379
9,428,970 B2 * 8/2016 Gustafsson ..... E21B 19/155
2005/0152772 A1 * 7/2005 Hawkins ..... E21B 19/155 414/22.54
2005/0173154 A1 * 8/2005 Lesko ..... E21B 19/20 175/57
2009/0127001 A1 * 5/2009 Felt ..... E21B 19/155 175/85
2010/0163247 A1 7/2010 Wright et al.
2011/0188973 A1 * 8/2011 Baumler ..... E21B 19/15 414/22.57
2013/0327541 A1 * 12/2013 Gustafsson ..... E21B 19/155 166/380
2015/0008038 A1 * 1/2015 Folk ..... E21B 19/155 175/52
2015/0144402 A1 * 5/2015 Gustavsson ..... E21B 19/20 175/52
2015/0152697 A1 * 6/2015 Gustavsson ..... E21B 19/15 175/52
2016/0115746 A1 * 4/2016 Wase ..... E21B 19/155 175/52
2016/0130890 A1 * 5/2016 Wase ..... E21B 19/155 175/52

OTHER PUBLICATIONS

PCT/ISA/237—Written Opinion of the International Searching Authority—dated Nov. 13, 2013 (Issued in PCT/SE2013/050761).

* cited by examiner

HANDLING DEVICE AND METHOD FOR HANDLING DRILL STRING COMPONENTS IN ROCK DRILLING AND ROCK DRILL RIG

CROSS-REFERENCE TO RELATED APPLICATIONS

This application claims priority to Swedish patent application 1250728-1 filed 28 Jun. 2012 and is the national phase under 35 U.S.C. §371 of PCT/SE2013/050761 filed 25 Jun. 2013.

FIELD OF THE INVENTION

The invention concerns a handling device for handling drill string components in respect of a drill rig, wherein the handling device includes a gripper unit for gripping drill string components to be placed into or be removed from an active drill string position (A) of the drill rig. The invention also relates to a corresponding method and a rock drill rig equipped with such a handling device.

BACKGROUND OF THE INVENTION

Core drilling for exploration purposes is usually performed with rock drill rigs, wherein the drill string components are placed in the active drill string position, lifted up from or lowered down in the drill hole with the aid of a winch. The winch wire is fastened to the uppermost drill string component with the aid of a lifting plug. Since core drilling aims to extract a drilled-out core of rock to be investigated, tubular drill string components are used. During lifting up of the drill string, which is performed frequently for exchange of drill bits, the string of tubes is lifted unit by unit, whereby the separate tubes are loosened from each other with the aid of the rotator device of the drill rig in co-operation with a lower tube holder.

Final loosening of a tube to be taken away from the drill string is today at least partly performed manually by the operators, wherein this handling includes final threading-off and lifting and guiding of the tube to an area of a tube magazine.

During lowering the drill string, the working steps are performed reversely such that new drill string components in the form of tubes are successively lifted to a position where they are aligned with the drill string and threaded together by the operator. These working steps are stressful and brings about a not negligible risk of being subject to lifting and clamping injuries for the operator.

Core drilling is often performed to very great depths, such as for example to drill length between 1000-2000 m. Because of the drill bit in operation being subjected to wear, it has to be exchanged relatively often, which results in that the entire drill string has to be lifted out from the drill hole, be dismounted into drill string components, the worn drill bit be removed and be replaced by a new one, whereupon the drill string can again be lowered down into the hole. Thereupon a further distance is drilled until the drill bit has to be exchanged again etc. During the drilling, a flushing liquid swivel is connected to the uppermost end of the drill string for supplying flushing liquid for transporting away rock material having been disintegrated during drilling.

Aim and Most Important Features of the Invention

It is an aim of the invention to provide a device of the above kind, wherein the problems according to the above are addressed and at least partly solved. This is achieved in respect of a handling device according to the above in that the gripper unit is swingably supported around a first swing axis in the region of the feed beam between:

a) a first position aligned with said active drill string position, and b) a second position aligned with a delivering position for drill string components to be placed into and removed from said active drill string position, wherein the handling device includes a swing arm, having support means for supporting a drill string component and which is swingable around a second swing axis between a loading position for drill string components and said delivering position, wherein a guiding beam is fastenable at its end regions in connection with the respective regions of the first and the second swing axis, and wherein the guiding beam forms mechanical stops for the gripper unit in said second position as well as for the swing arm in the delivering position.

Through the swingability of the gripper unit it is obtained that in the first position it is arranged to actively align end portions of drill string components to be joined to each other. Hereby it is possible to achieve overall accurate alignment between drill string components, to be joined, and to be separated, safely allowing adequate handling of drill string components during the threading operations and avoiding thread damages, which can be the result of erroneous thread joining attempts. It is also important that threading apart is aligned and controlled.

Through the swingability to the second position, it is obtained that the gripper unit in this second position will be capable of engaging an end portion of a drill string component in the delivering position in order in this position, in a corresponding way, to provide alignment before threading on and threading off of a lifting plug or a flush liquid swivel (in case of a last drill string component of the drill string) on to or off from the gripped drill string component. The gripper unit thus provides fastening of a lifting plug or a water swivel on the drill string component in the delivering position.

The swing arm of the handling device provides that a supported drill string component is swung from a loading position for drill string components, which e.g. suitably is a horizontal position, to said delivering position, which usually is an inclined position of the supported drill string component.

The drill string component can be transferred manually or through any per se known transport method to the loading position. In the delivering position thereupon aligned co-operation with the gripper unit in its second position is provided.

In order to effectively and safely ensure accurate alignment between the gripper unit and the drill string component being supported by the swing arm, according to the invention, a guiding beam is arranged which forms mechanical stops for the gripper unit in said second position as well as for the swing arm in the delivering position. For this purpose, the guiding beam is fastenable at its end regions in connection with the respective regions of the first and second axes. This arrangement results in that the guiding beam in each adjustment position of a drill rig, for example with different inclinations of the feed beam, with varying inclination of a support for the rig, and different vertical positions of the parts of the rig, more or less automatically can provide on the one hand setting references through said mechanicals stops, on the other hand more or less automatically also provide suitable end positioning of the drill string component being carried by the swing arm in respect of the gripper unit.

The invention results in major advantages when it comes to handling. It should be noted that the alignment requirements for threading together drill string components for core drilling are very strict. Thus is not tolerated an alignment deviation of components to be threaded together of more than 1°. Greater angular deviations most likely results in failing threading and in more serious cases to thread damage.

It is preferred that the guiding beam is pivotally attachable around the first pivot axis in connection of an area of the first swing axis and in particular that the first pivotal axis is at least essentially co-axial with the first swing axis. Likewise it is preferred that the guiding beam is fastenable so as to be pivotal around a second pivot axis in connection with a region of the second swing axis, and particularly that the second pivot axis is at least essentially co-axial with the second swing axis. These arrangements one by one facilitates and can, particular taken together, even eliminate the need of adjusting the guiding beam and/or therewith co-operating means on the gripper unit respectively the swing arm after repositioning of the rig or even in case of an unintentional movement of the rig or of the support (such as the magazine) for the end of the guiding beam which is facing away from the rig.

In a first position of the gripper unit it is positioned to engage an end portion of a first drill string component respectively an end portion of a second drill string component. In the second position, the gripper unit is positioned in order to engage aligned with an end portion of a drill string component to be brought into respectively is in the process of being taken out from said active string drill position.

Suitably the guiding beam, i.a. for manufacturing purposes, has linear extension.

Preferably the swing arm and/or the gripper unit in a respective distal region, opposite to a region of the respective pivot axis, have abutment elements for alignment contact with abutment means on the guiding beam in said delivering position. Suitably at least one of said abutment elements and said abutment means is adjustable for adjustment of alignment position.

Preferably the swing arm and/or the guiding beam includes mutual guiding elements for lateral alignment of the swing arm in the delivering position in order, to a certain degree, to eliminate an effect of a mutual lateral obliqueness of the swing arm in respect of the guiding beam.

It is preferred that the guiding beam is provided with a longitudinal guide and a gripper shuttle being drivingly moveable along the longitudinal guide, said gripping shuttle being provided with a pivotally arranged guiding gripper for guiding a first end region of a drill string component, the other end region of which being arranged to be engagement with a lifting plug. This arrangement essentially facilitates handling during the process of lifting with a lifting wire and of applying a drill string component into the drill string position as well as during the process of lifting and removing a drill string component from the drill string position. No corresponding guiding is in principle provided according to the background art, but instead it is up to the operator to see to that, in the most uplifted position of the drill string component, when it hangs in the lifting wire, accurate positioning into the drill string position is made and an adequate removal from the drill string position to a delivering position for further transporting. The arrangement with a gripper shuttle instead allows safe and accurate guiding of a free end of a lifted drill string component in the respective position.

The invention also concerns a rock drill rig including a rotator device for rotation and driving of a drill string and being moveable to and fro supported by a feed beam and a handling device according to the above.

The invention further concerns a method for handling drill string components in respect of a rock drill rig. This method is distinguished in that the gripper unit is swung around a first swing axis in the region of the feed beam between:

a) a first position aligned with said active drill string position, and b) a second position aligned with a delivering position for drill string components to be placed into and removed from said active drill string position, wherein a swing arm, having support means for supporting a drill string component is swung around a second swing axis between a loading position for drill string components and said delivering position, and wherein a guiding beam being fastenable at its end regions in connection with the respective regions of the first and the second swing axis, and wherein the guiding beam mechanically stops the gripper unit in said second position as well as the swing arm in the delivering position.

The advantages indicated above in respect of the inventive handling device and the subordinate features are applicable also in respect of the inventive method.

The invention will now be described in greater detail by way of embodiments and with reference to the annexed drawings.

DESCRIPTION OF EMBODIMENTS

Figure 1:
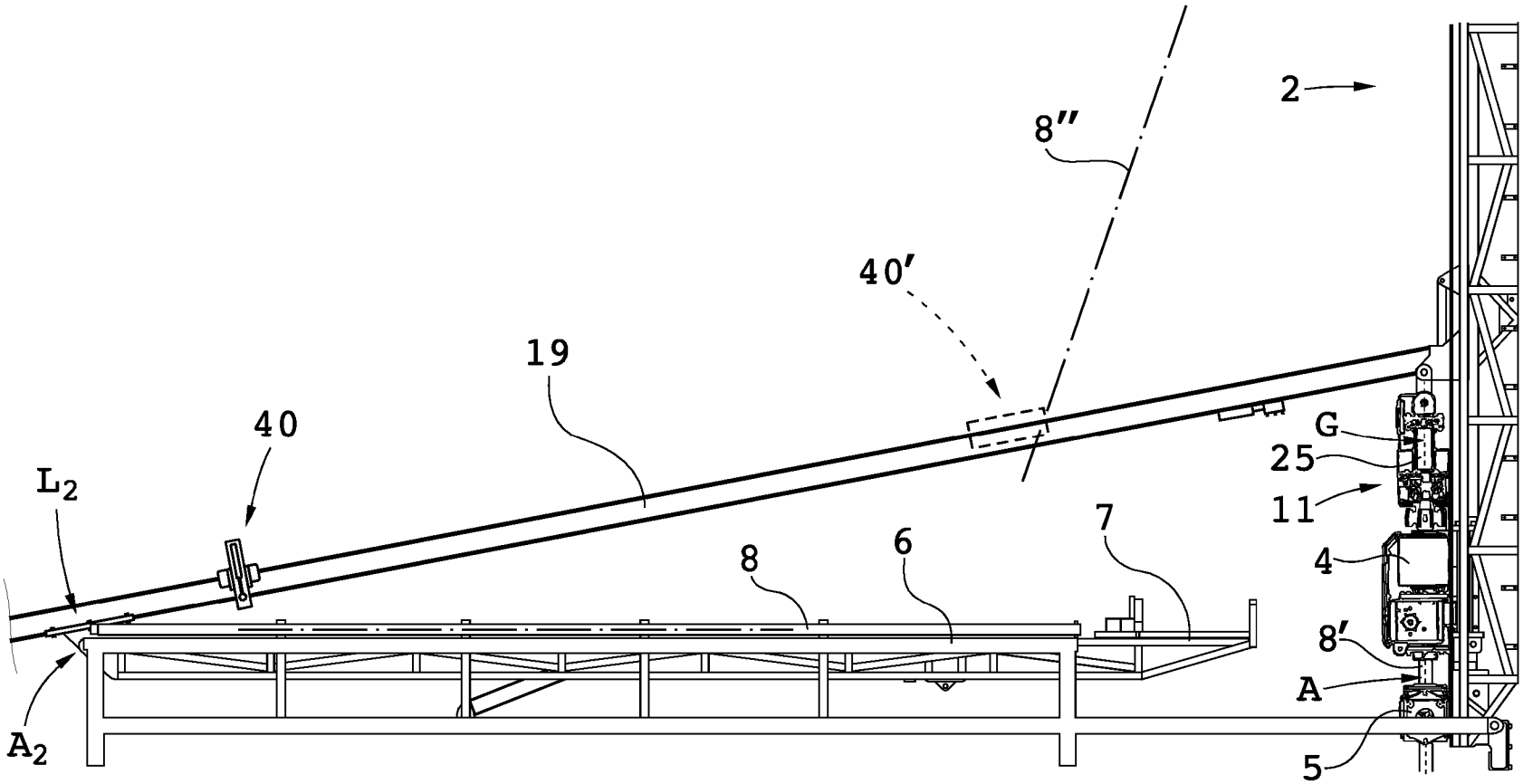
FIG. 1 shows in a side view rock drill rig for core drilling provided with a handling device according to the invention and in connection with a magazine for drill string components.

FIG. 1 shows a feed beam 2 of a rock drill rig for core drilling being adjustable in different angles. The rig includes a rotator device 4, which is supported on the feed beam 2 for movement to and fro. Below (in the Figure) the rotator device 4 is arranged a tube holder 5 for temporary holding the drill string when this is required.

Beside the feed beam 2 is arranged a (not shown) power and driving aggregate for proving pressure fluid etc to the rock drill rig and a lifting winch (not shown). A magazine 6 is arranged for receiving drill string components (indicated with interrupted line at 8), to be brought into respectively taken out from the rock drill rig in a manner will be described below.

The magazine 6 can be constructed in various manners but is in FIG. 1 exemplified in the form of a generally horizontal table, which is tiltable such that drill string components 8 can be brought to roll towards a swing arm 7 for reception of drill string components 8.

In FIG. 1 is further indicated with a dot interrupted line at 8", a drill string component in a position during a lifting phase which is a slanting position in respect of the feed beam 2.

This line at 8" in FIG. 1 is intended to illustrate an intermediate position during the lifting phase which is ended by the drill string component being in a position which is co-axial with an active drill string position of the rock drill rig. Lifting is performed with the aid of a lifting plug (25 see below) being threaded-in uppermost on the drill string component. The lifting plug is during this process in turn connected to a (not shown) lifting wire, which passes over a wire wheel (not shown) uppermost on the feed beam and with its second part extends essentially in parallel to the feed beam 2 to the lifting winch (not shown) being arranged in the region of the power and drive aggregate 3.

Furthermore, on FIG. 1 is shown a lifting plug 25 being gripped by a gripper unit 11 and being threaded on to an end portion of a drill string component 8' being in a drill string position.

FIG. 1 further shows that said end portion is protruding out from the rotating device 4 such that this drill string component 8' is in an active drill string position A. The drill string component 8' has a female thread for engagement with a corresponding male thread on the plug 25.

Threading on of a further, second drill string component 8" on the first drill string component 8' for the purpose of lengthening the drill string for subsequent lowering into the drill hole is essentially corresponding to the method for threading on of a lifting plug. See below.

The gripper unit 11 is shown in a first position in FIG. 1, in which a gripping position is defined by the gripper unit 11 and which provides a gripping position axis G (see interrupted line in FIG. 1), is co-axial with said active drill string position A.

Further in this Figure is shown in greater detail a guiding beam 19, which is arranged to provide a stop for the swing arm 7 in an upwardly swung delivering position of a supported drill string component 8. Furthermore, the guiding beam 19 provides stop for the gripper unit 11 in the second position thereof. Support means in the form of a tray for supporting a drill string component is indicated with 7'.

Figure 2:
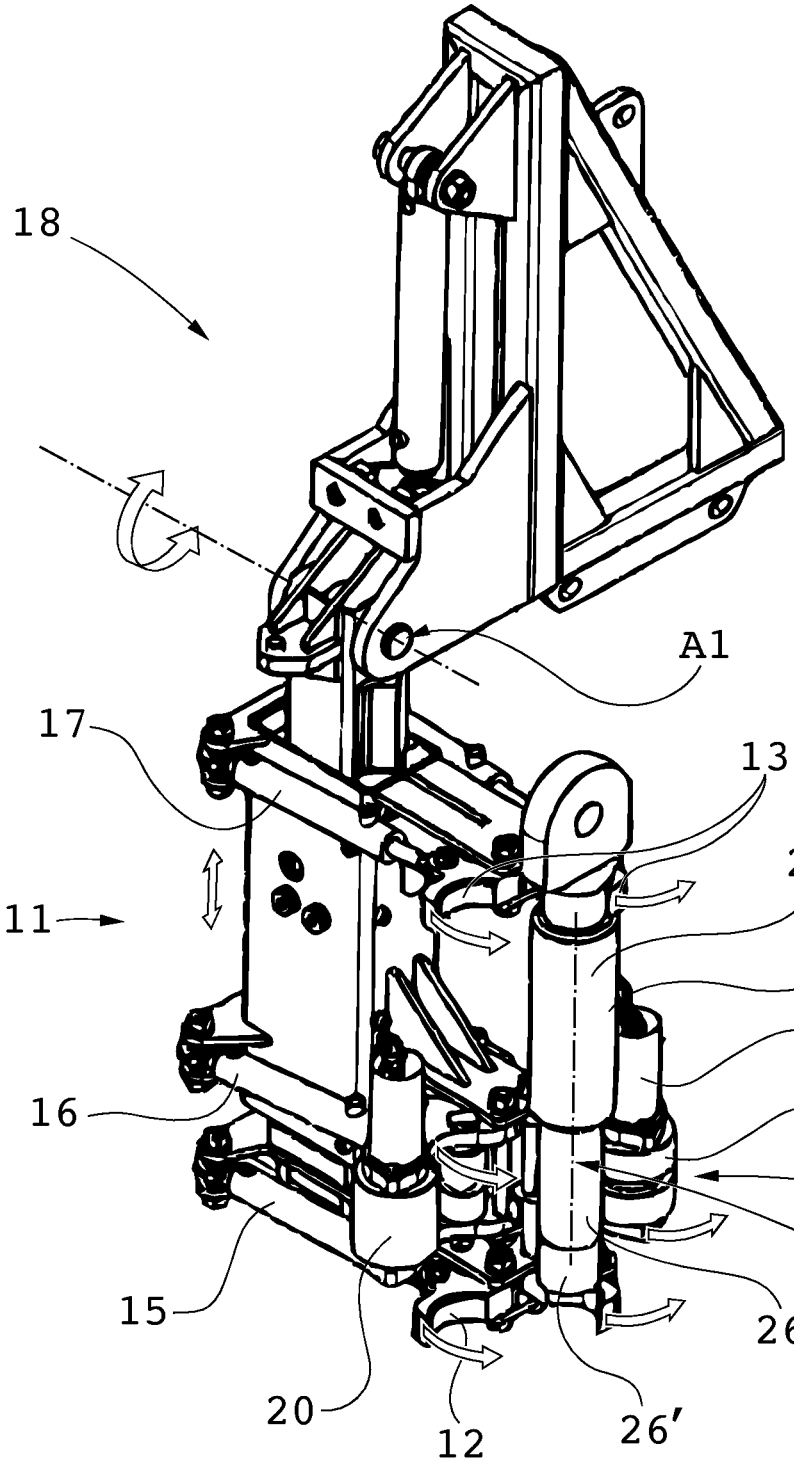
FIG. 2 shows in a perspective view the gripper unit isolated and in a greater scale.

The gripper unit 11, which is shown in greater detail in FIG. 2. has a first set of grippers 12 for engagement with said first drill string component 8' (in FIG. 1) and rotation means 14 in the form of a rotation gripper unit, which has driving rollers 20 for engagement with the component such as a drill string component to be rotated as well as driving motors 21 for these driving rollers. Further, the gripper unit 11 is provided with a second set of grippers 13 for co-operation with the rotation gripper unit for engagement with a component. Each set of grippers 12 and 13 includes a pair of gripping elements such as gripping jaws which suitably can be individually manoeuvrable in order to function also as stoppers for a forwarded drill string component. The same is valid for the rotation gripper unit which includes a pair of rotation gripper means.

The first set of grippers 12 is manoeuvred by hydraulic cylinders whereof one is indicated with 15 and the second set of grippers is manoeuvred with the aid of hydraulic cylinders 17.

The rotation means 14 with the driving rollers are supported on swingable rotation clamping means which are brought into engagement with the component to be rotated by means of hydraulic cylinders whereof one is shown and is indicated with 16.

A part of the gripper unit 11 including the rotation means 14 and normally also the second set of grippers 13 is displaceable in a direction in parallel to said gripping position axis 3. See double arrow. The purpose of this displaceability is to impart part of the gripper unit 11 and in particular the rotation means 14 an axial movement and a rotation of the driving rollers such that it is compensated for the thread pitch during rotation driving of component to be rotated.

FIG. 2 further shows a swing unit 18 which is attached to the rig and supports the gripper unit 11 for swinging around a first swing axis A1 between the position shown in FIGS. 1 and 2 (a first position) and a outwardly swung position (a second position), which is described below.

In FIG. 2 the sets of grippers 12 and 13 is shown with the one respective gripping jaw open. In general, open second set of grippers and rotation means 14 brought in for engagement with a plug of the drill string component allows rotation of the plug or the drill string component 8 without obstruction from engagement with a second set of grippers 13. After bringing a further drill string component into a position above an existing one in position A (instead of the lifting plug 25 in FIG. 1), the drill string components are thus threaded together by the rotation means, whereupon the joint as usual is finally tighted by the rotator device 4. Thereupon the drill string can be lowered by slacking the lifting wire. (joining of course is performed in the same way when the drill string has sunk through drilling.)

Thereupon the drill string is lowered down to a position being shown in FIG. 1, whereby the next drill string component has reached the position being indicated with 8' with an end portion protruding out from the rotator device 4 and with a lifting plug 25 being above this drill string component. This lifting plug will now be loosened from the drill string.

The lifting plug 25 is a swiveling device and therefore has two mutually rotatable parts, which is shown in FIG. 2, namely an engagement portion 26, which at its lower portion is provided with a male thread 26' at its free end which is directed against the drill string component and a lifting portion 27, which outermost is provided with a lifting eye for co-operation with a lifting wire as is described above.

The rotation gripper unit of the gripper unit 11 includes the driving rollers 20, which have a surface with engagement means for ensuring a good engagement grip against a component to be rotated. The drive motors 21 are in the shown example arranged laterally of the driving rollers 20 and together with these supported on a swing arm construction supporting a rotation means 14.

When the gripper unit 11 is activated such that the rotation means 14 and the second set of grippers 13 are displaced axially in the direction from the drill string component 8, the driving rollers 20 are put into rotation for rotation driving of the engagement portion 26. The lifting plug 25 is brought axially in the direction from the drill string component it is to be free from. The lifting portion 27 is at the same time held by said second set of grippers 13 in order to prevent rotation thereof and for preventing unwanted rotation to be imparted to the lifting wire.

Thus, the first set of grippers 12 has gripped the end portion of the drill string component 8' whereas the rotation means 14 have come into contact with the engagement portion of the lifting plug 25 and the second set of grippers 13 have come into contact with the lifting portion 27 of the lifting plug 25, whereupon the loosening of the lifting plug 25 is preformed through rotation of the rotation means 14.

When the lifting plug 25 is loosened from the drill string component 8' (FIG. 1) it is swung by the action of the swing unit 18, which carries the gripper unit 11, from the first position in the direction of said second position. In order to allow this swing, the first set of grippers 12 have opened while still the rotation means 14 as well as the second set of grippers 13 are in engagement with the lifting plug 25.

Figure 3:
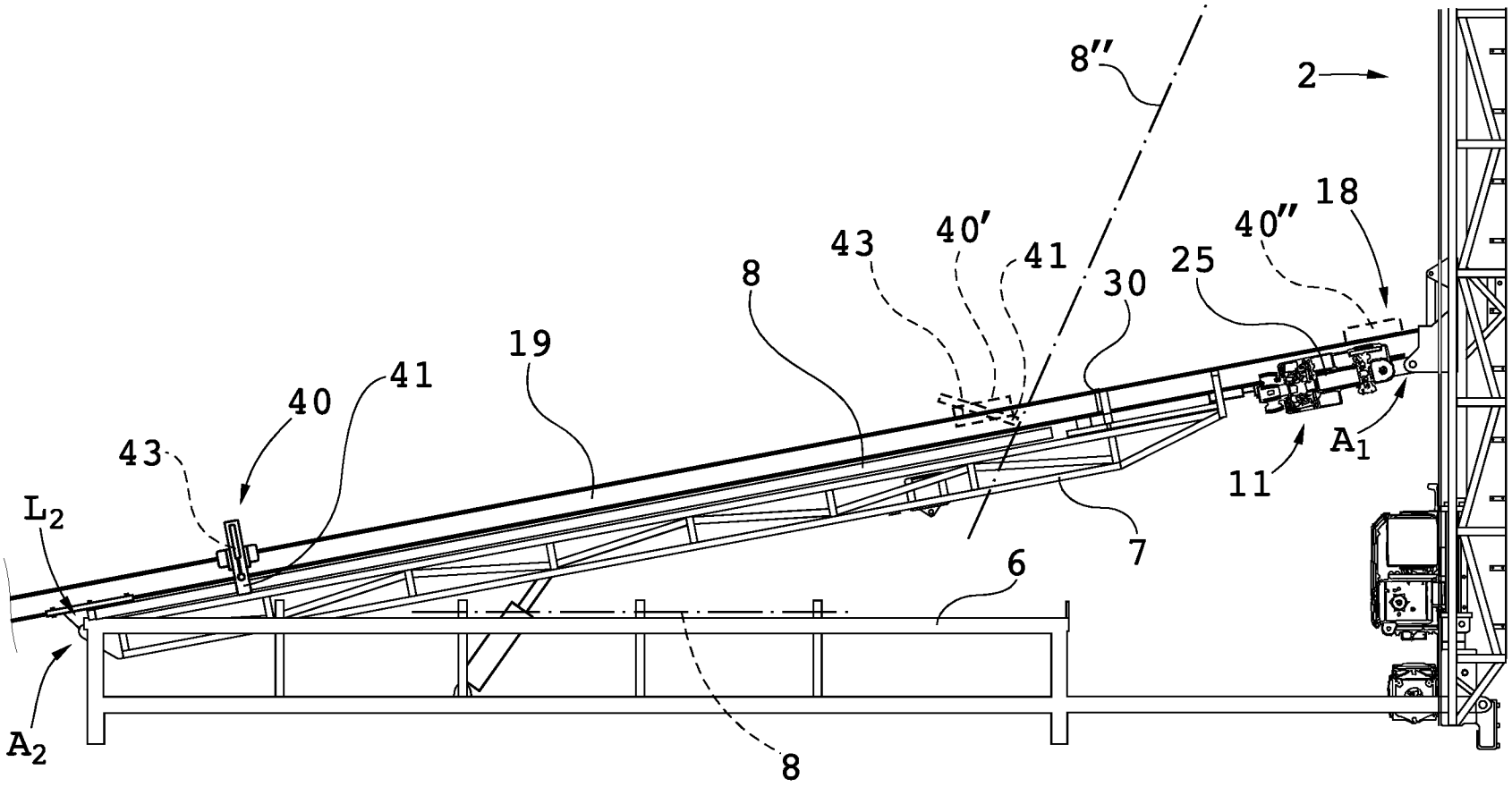
FIG. 3 shows a side view corresponding to FIG. 1 with the means of the handling device in another position.

FIG. 3 shows that said swing unit 18 has swung the gripper unit 11 with supported lifting plug 25 to the second position where the gripping position is aligned for co-operation with a drill string component 8 being supported by the swing arm 7 being connected to said magazine 6. This determined position of the gripper unit 11 is ensured by the guiding beam 19 forming a mechanical stop for the swing movement of the gripper unit 11 in said second position.

FIG. 3 also shows that the swing arm 7 has swung up around the second swing axis A2 to the delivering position, wherein, correspondingly, the guiding beam 19 is a mechanical stop for the swing movement of the swing arm 7 in the delivering position.

Figure 5A:
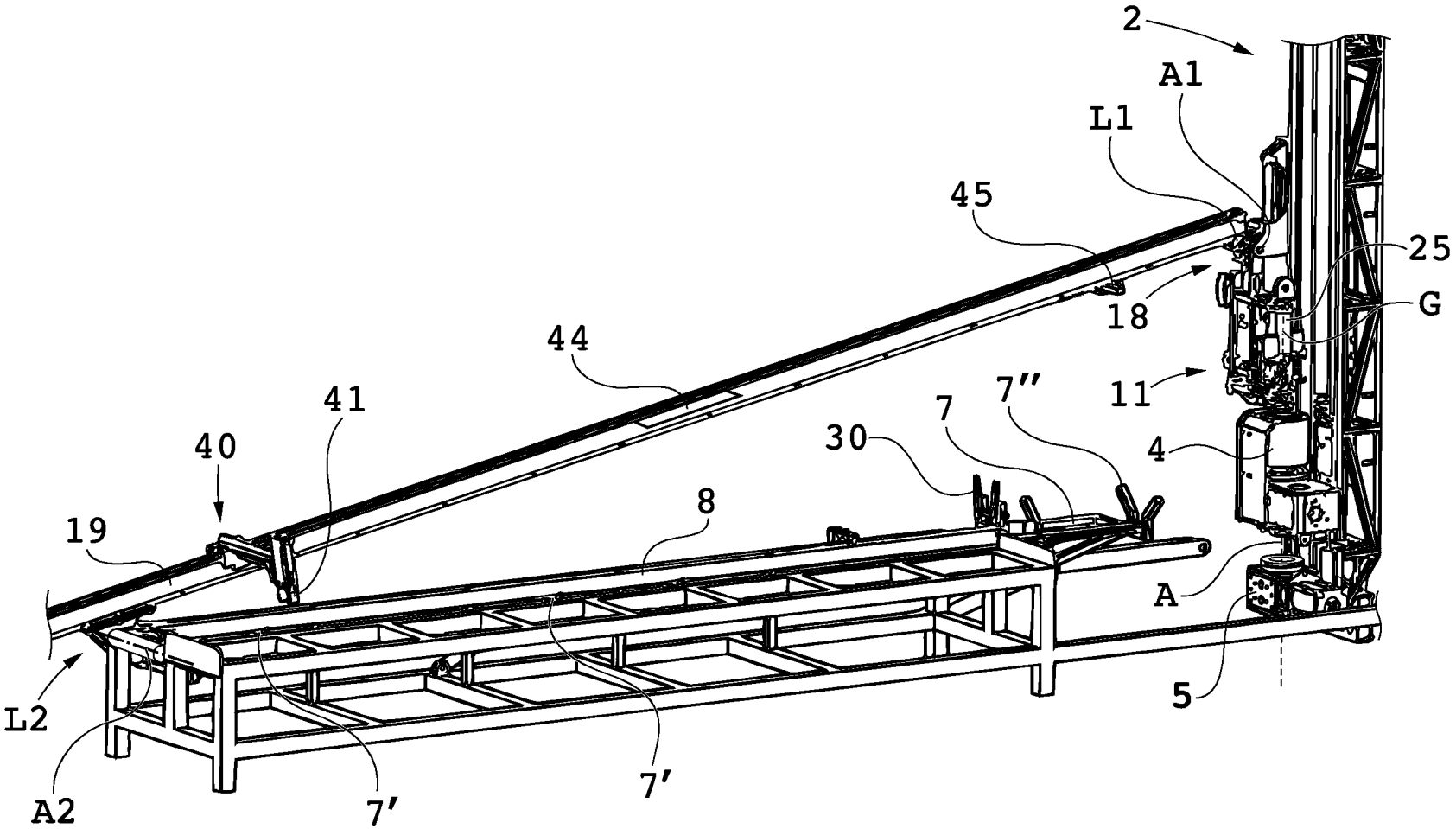
Figure 5B:
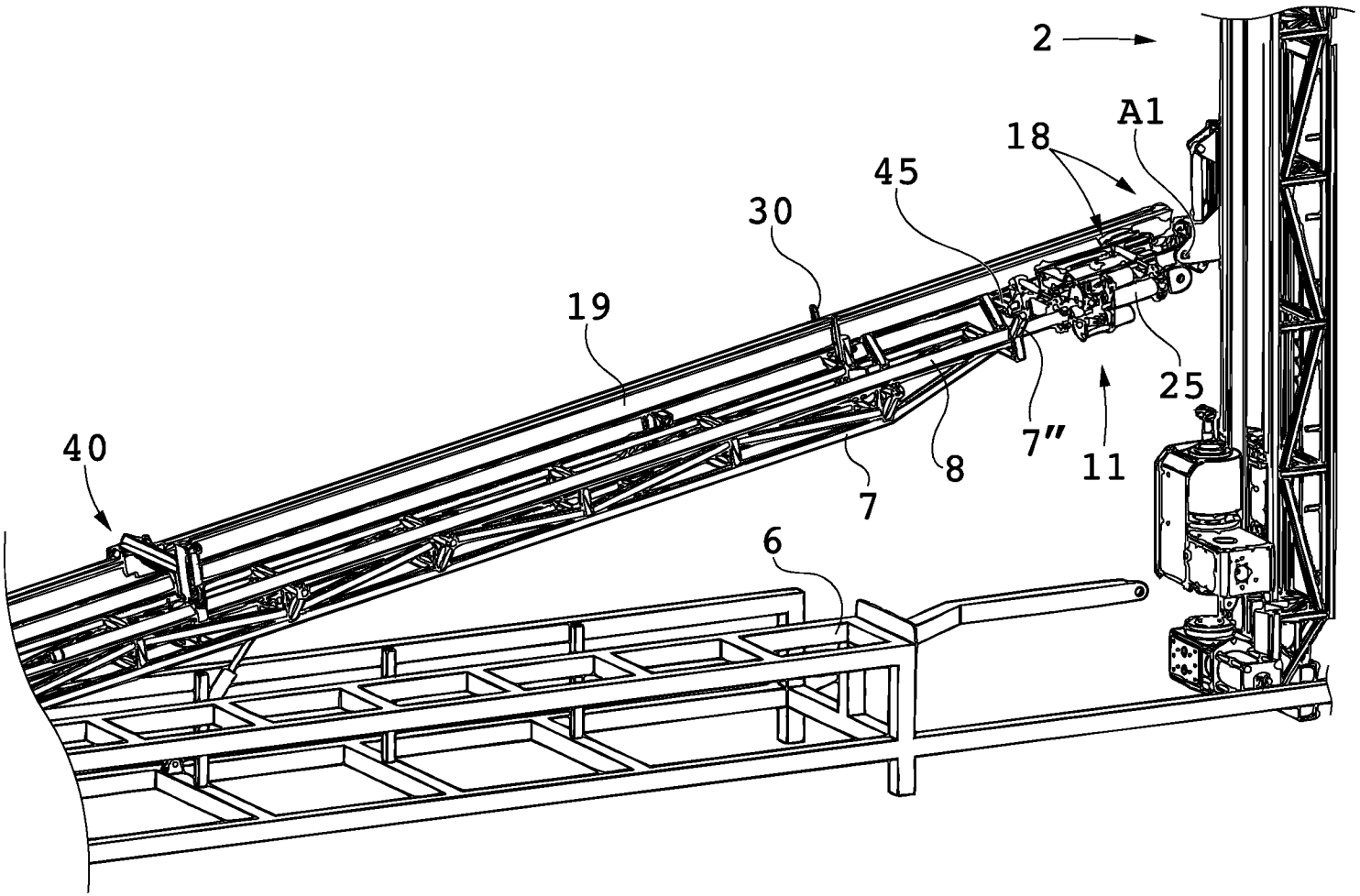

Suitably at least any one of the swing arm 7 and the gripper unit 11 carries, in a respective distal position, opposite to a position of the first and the second swing axes respectively a (not shown) abutment element for alignment contact with the guiding beam which here suitably is provided with a particular (not shown) abutment elements in the form of a metal plate, an abutment arm or the like. An example of an abutment arm for co-operation with the swing unit 8 supporting the gripper unit 11 is shown in FIGS. 5*a* and 5*b*. At least one of said abutment elements and said abutment means is suitably adjustable for adjusting an alignment position by means of suitable per se known distance adjustment means (not shown). On the swing arm there is also a fork-shaped guiding element 30 for lateral alignment of the swing arm in the delivering position by this one the fork grips around side edges of the guiding beam in the delivering position. The corresponding can be arranged on the guiding beam and also the gripper unit can be provided with respectively be subject of engagement with the corresponding guiding element.

It should be noted that said first set of grippers 12 are in a position for grip engagement with the drill string component 8 when it has reached said delivering position. The end of the drill string component 8 with a female thread outermost will now, in the delivering position, be accessible for gripping by the gripper unit 11.

The lifting plug 25 is simultaneously held by the rotation means 14 forming a rotation gripper unit and the second set of grippers 13 and is now ready for threading together with the drill string component 8.

For the purpose on compensating for the thread pitch during threading, a unit including the rotation means 14 and the second set of grippers 13 will also in this case be displaced axially in the direction of the drill string component 8 and the driving rollers be rotated.

After completed threading of the male thread 26' on the engagement portion 26 (see FIG. 2) into a female thread in the drill string component 8, the first set of grippers 12 as well as also the rotation means 14 and the second set of grippers 13 are opened. Hereby the drill string component 8 is free to be lifted with the aid of the lifting wire such that it i.a. passes the position shown with dot interrupted line (8") and subsequently ends up in the position of the second drill string component along the "grip position axis" indicated with G in FIG. 1.

Figure 4:
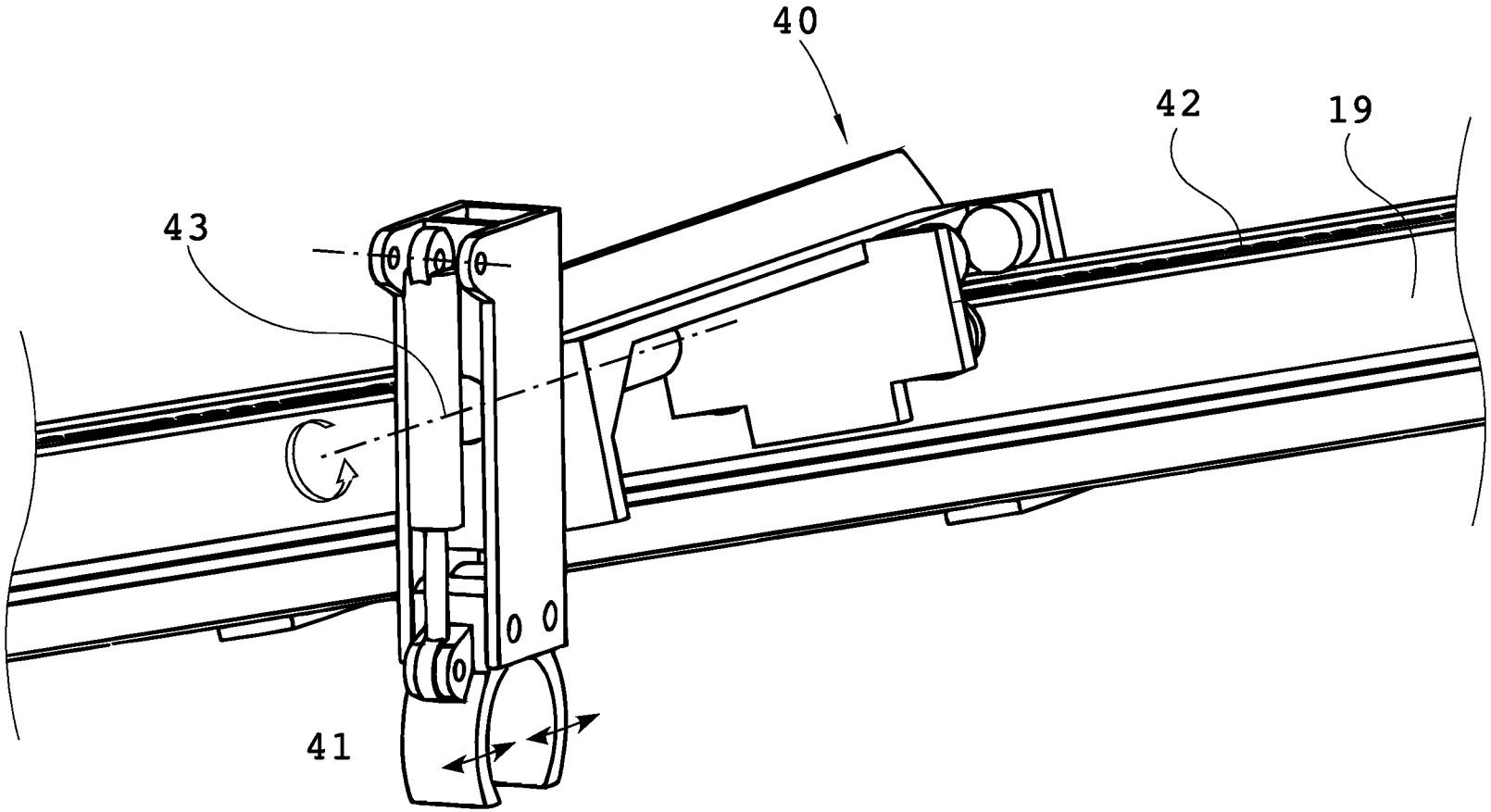
FIG. 4 shows in a perspective view a gripper shuttle of the handling device, FIGS. 5*a* and *b* show in greater scale perspective views of the handling device in general corresponding to the positions in FIGS. 1 and 3.

Before the drill string component 8 has been free from the grippers, in the region of the second end, opposite to the end that has been threaded together with the lifting plug, it has been gripped by a guiding gripper 41 being pivotally attached to a gripper shuttle 40, said guiding gripper 41 being manoeuvred by a hydraulic cylinder. An embodiment thereof is shown in more detail in FIG. 4. Thereupon the swing arm 7 is lowered to the loading position (in FIG. 1) where it is out of the way for the movements of the gripper shuttle 40.

The guiding beam 19 is provided with a longitudinal guide 42 for the drivingly displaceable gripper shuttle 40. The pivot 43 has a pivot axis essentially in parallel with the first and the second swing axes A1 and A2 for allowing swinging in the same plane that includes the drill string position and the delivering position.

The guiding gripper is arranged such that after gripping said drill string component 8 it guides the free end thereof for controlling its movement during the lifting process and for guiding this free end to be lined up with the drill string position A in the rig. With activated guiding gripper gripping a drill string component and running gripper shuttle it is arranged such that the guiding gripper follows the pivotal movement without being rotationally controlled in itself. For guiding purposes in order to come into the right position for gripping of a drill string component, on the one hand in the outermost position as is shown in FIG. 3, on the other hand in the inner position adjacent to the feed beam, however, active rotational control must be performed of the guiding gripper around the axis of the pivot 43. This is suitably accomplished by the gripper shuttle being provided with a rotational actuator for the guiding gripper 41, said rotational actuator can be in the form of a hydraulic cylinder or any other type of rotational actuator of a per se known kind, acting between two end positions according to the above.

With reference again to FIG. 3, there is shown that the gripper shuttle 40 with its guiding gripper 41 is in a first position (with full lines) in a first outermost position of the guiding beam in order there to grip the first end portion of the drill string component 8 intended for lifting, the other end portion of which being intended to be in threaded engagement with the lifting plug or the like for co-operation with said lifting winch.

Figure 7A:
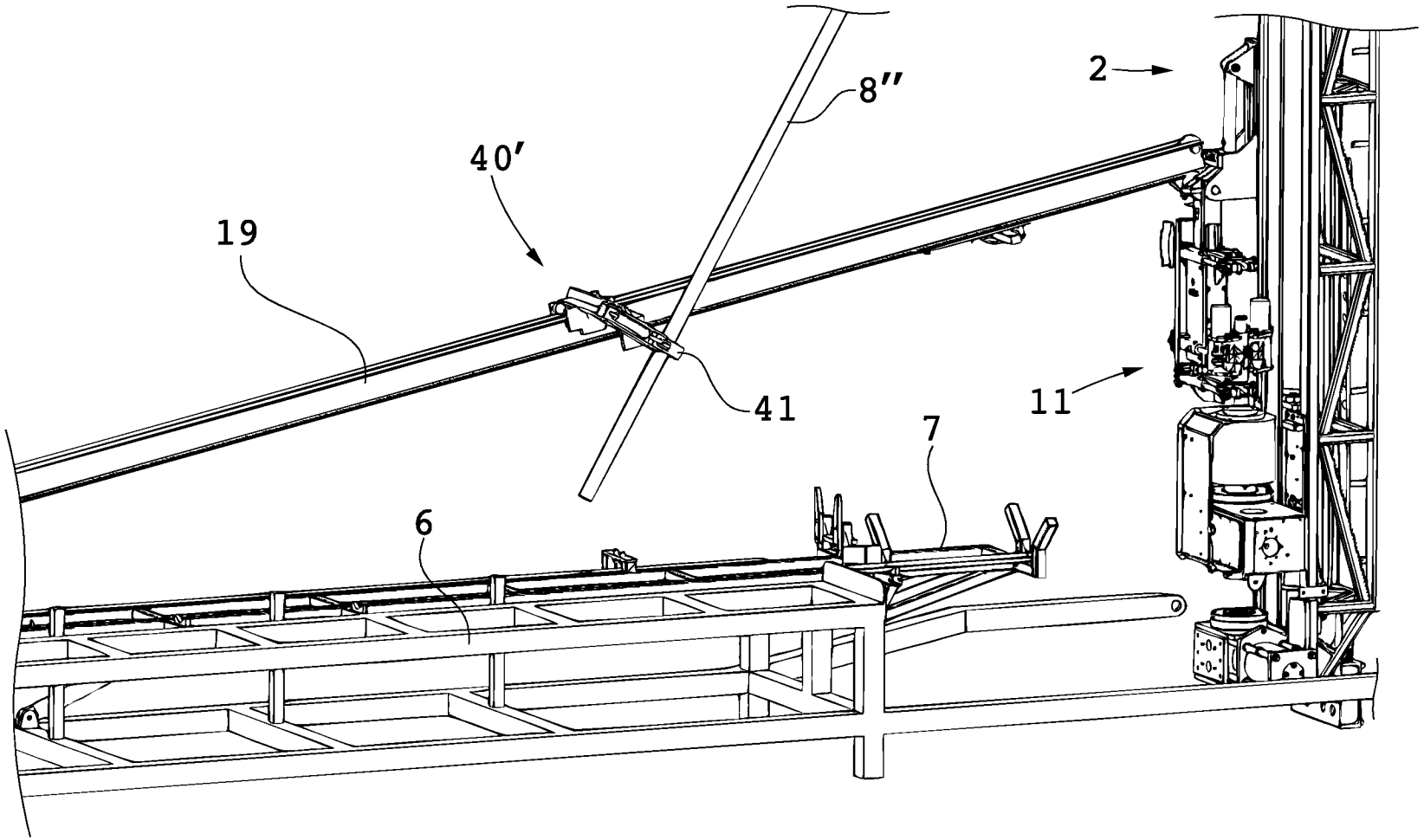

In an intermediate position more clearly shown in FIG. 7*a* the gripper shuttle indicated with the reference numeral 40' (with interrupted lines in FIGS. 1 and 3) is guiding the drill string component 8".

Figure 7B:
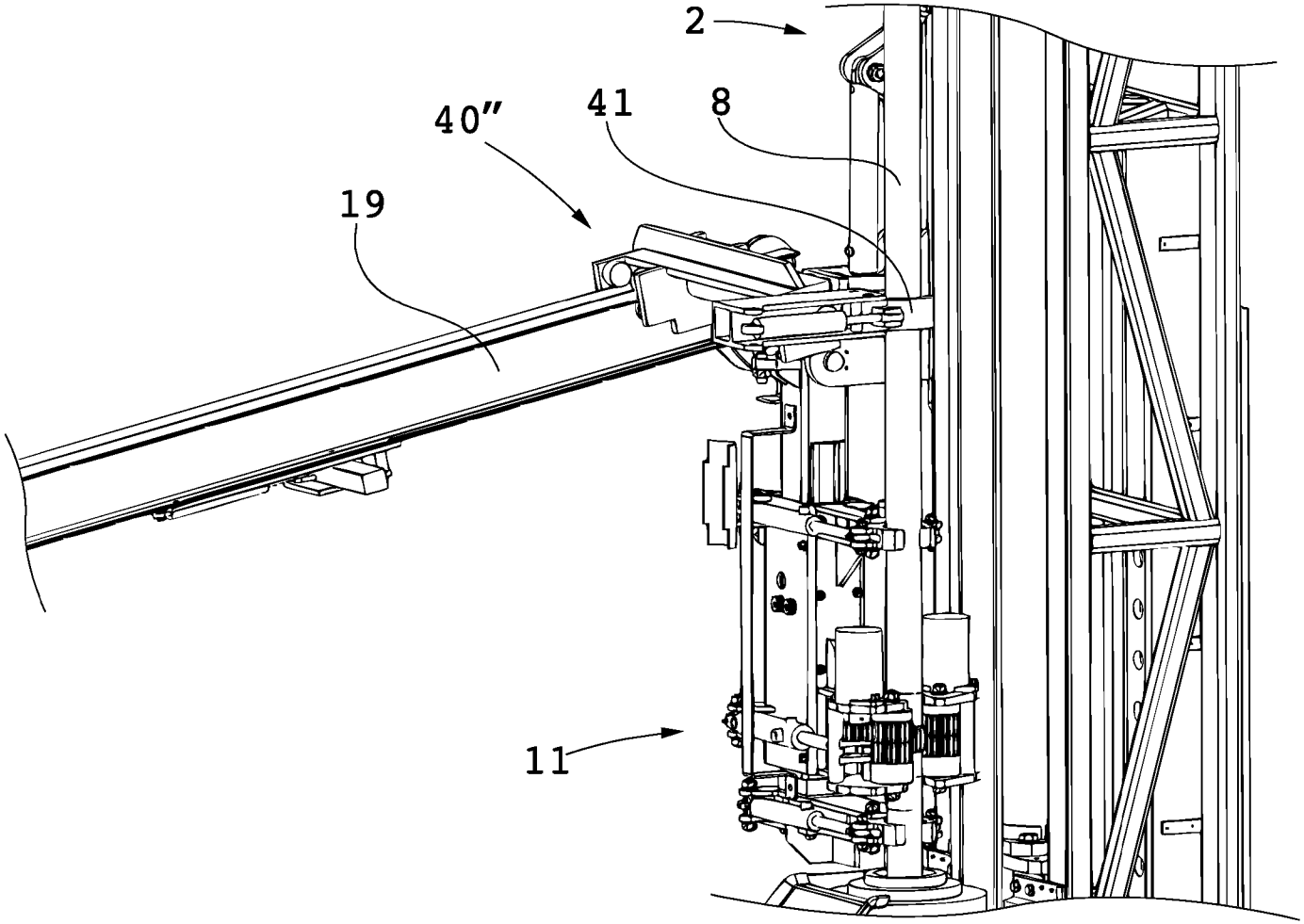

The gripper shuttle is also shown clearly in FIG. 7*b* indicated with the reference numeral 40" (with interrupted lines in FIG. 3) in a second position in a second, inner position of the guiding beam close to the feed beam 2. Here, it is arranged together with the guiding gripper 41 to line up said gripped drill string component in the region of the drill string position. Normally, such an alignment can be performed against an alignment aid (not shown here) being normally arranged at the feed beam and being moveable back and forth for guiding-in the incoming lower end of a drill string component.

The guiding beam is pivotally attached at a first pivot axis L1 in connection with a region of the first swing axis A1 which preferably is such that the first pivot axis L1 is co-axial with the first swing axis A1. The guiding beam 19 is also pivotally attached at second pivot axis L2 in connection with a region of a second swing axis A2 which preferably is such that the second swing axis L2 is co-axial with the second swing axis A2. Hereby a desired reference for stop of swing movements of the swing arm as well as the gripper unit be had when setting up and repositioning the rig in an easy way without the requirement of applying a complicated measuring method or the like since the guiding beam after adjustment of the rig will automatically have an adequate direction when a support (such as a magazine 6) for the guiding beam on the end being directed from the feed beam is anchored to the ground.

As is apparent and is shown in the Figures, the swing arm as well as the gripper unit swings in the shown embodiment and with the shown setting of the rock drill rig in a vertical plane or at least in a plane including an axis of the drill string position A in the rig or in the plane being parallel to such planes, whereby the axes A1 and A2 are (essentially) horizontal. If there is a need to position the feed beam laterally slanting it should of course be necessary to have the corresponding obliqueness of the axis A1 and A2 and L1 and L2, respectively.

It is preferred that the swing arm 7 swings in a vertical plane or in a plane including an axis of the drill string position A in the rig, or in a plane being parallel with such a plane until it reaches a position where it is aligned with the guiding beam. It is, however, not excluded that the swing arm has a coupling to the guiding beam allowing alignment in a variant where the swing arm describes an alternative movement for example a combination of a horizontal and a vertical swing movement. A (not shown) variant with two pivot axis L2' and L2" extending for example at an angle to each other is also not excluded. This could be of interest if for example for handling purposes there would be a requirement to arrange the loading position differently from what is shown in the Figures.

After placing and guiding-in of the new drill string component it can be threaded together with the drill string as is described above.

So far the operative functions of the handling device according to the invention have been described for lowering a drill string after for example exchange of a drill bit. During taking up of the drill string the reverse process is used in principle, namely threading-on of the lifting plug on to a drill string component being in the active drill string position, pulling up of the lift plug with connected drill string to a position where the rotator device in a per se known manner is arranged to unthread the uppermost drill string component from the subsequent drill string component.

Thereupon there is a further lifting of drill string such that the next drill string component with its end portion finds itself in the position being shown in FIG. 1, whereupon the gripper unit 11 comes in and with the rotation means 14 grips the uppermost drill string component and with a first set of grippers 12 grips the next drill string component ("the first") for the purpose of alignment in connection with the rotation means 14 being driven for controlled unthreading of this drill string component.

Thereupon the thus loosened drill string component is gripped by said guiding gripper and is brought through the movement of the gripper shuttle 40 away from the feed beam 2 out from the position in parallel with the active drill string position with its lower end at the same time as the lifting wire is slacked in a controlled manner such that the drill string component finally reaches the delivering position. Here it and the lift plug can be gripped by the grippers of the gripper unit 11 for unthreading the latter. Lifting of the swing arm 7 for receiving the drill string component now occurs and when the unthreading is completed, the swing arm can be lowered for transporting away the supported drill string component to a magazine or the like. Thereupon the process can be repeated as many times as necessary.

FIGS. 5*a* and 5*b* show for clarifying purposes part views in the positions of the parts corresponding to respectively FIG. 1 and FIG. 3 in perspective in enlarged scale.

44 indicates a support for a cable/tube chain (not shown). 7' indicates V-shaped supports for a drill string component being supported by the swing arm 7. 7" indicates a V-shaped adjustment fork for drill string components positioned at a free end of the swing arm.

Figure 6:
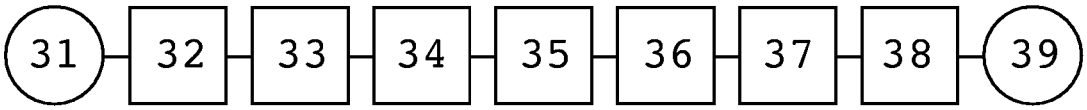
FIG. 6 shows diagrammatically a flowchart of a method according to the invention, and FIGS. 7*a* and *b* show in greater scale perspective views of the handling device in different positions.

In FIG. 6 is diagrammatically illustrated a method sequence including a method according to the invention concerning take-up of a drill string in a rock drill rig for, for example, exchange of drill bit, wherein:

Position 31 indicates start of the sequence.

Position 32 indicates pulling up the drill string to an uppermost position and ensuring that the rotator device is in its lowermost position after it has loosened the uppermost drill string component from the next drill string component.

Position 33 indicates swinging-in of the gripper unit to the first position.

Position 34 indicates activating the first set of grippers for gripping an end portion of the lowermost drill string component (8' in FIG. 1) and of the rotation gripper unit for gripping an end portion of the uppermost drill string component (8"; indicated in FIG. 1).

Position 35 indicates loosening of the uppermost drill string component through the rotation gripper unit and thereupon opening of all grippers of the gripper unit.

Position 36 indicates taking out of the free drill string component and placing it in a delivering position where it is supported on a swing arm assisted by the guiding gripper.

Position 37 indicates swinging of the gripper unit to the second position and gripping the lifting plug and the end portion of the free drill string component for release of the lifting plug through the rotation gripper unit.

Position 38 indicates swinging of a swing arm to the loading position for removal of the drill string component.

Position 39 indicates the end of the sequence.

This sequence is intended to be repeated as many times as necessary. When instead it refers to lowering of a drill string, for example after exchange of a drill bit, the steps are generally preformed in the reverse order, which is described in detail at the background of the drawings.

The invention has been described at the background of a rock drill rig for core drilling, but is also applicable for other types of rigs such as for oil drilling and the like.

The invention can be modified within the definitions of the claims. The swing movements of the swing arm and the gripper unit can be different through different types of components and they can be attached to any other component than the feed beam of the rig.

The guiding beam can be attached with pivot pins being common elements with pins for said swing axis. Fastening vis á vis the rig/the feed beam and the support/magazine respectively can be arranged with screw means, through welding etc. The longitudinal guide can be comprised of an external portion on the guiding beam such as side edges of flanges of an H-beam, an E-beam or the like. The gripper shuttle is preferably driven over a wire or the like by a driving motor, the gripper shuttle can also carry the driving motor acting against the guiding beam.

The swing arm can be constructed in various manners and have different means of per se known kind such as of chute shape, fork shape etc, for co-operation with the supported drill string component. For adaption to different lengths of drill string components, any of the support means 7' or a chute on the swing arm is suitably provided with adjustable or exchangeable end stops.

It is preferred that the gripper unit is provided with said first set of grippers for gripping said end portion of the first drill string component. It is, however, not excluded that the first set of grippers is exchanged with a guiding alignment device without gripping function.

The invention claimed is:

1. A handling device for handling drill string components with respect to a rock drill rig comprising a rotator device being supported moveably to and fro on a feed beam and being arranged for rotation and driving of a drill string component, the handling device comprising:

a gripper unit for gripping drill string components to be placed into or be removed in or from an active drill string position of the drill rig, wherein the gripper unit is swingably supported around a first swing axis in a region of the feed beam between:

a first position aligned with said active drill string position, and a second position aligned with a delivering position for drill string components to be placed or be removed in or from said active drill string position, a swing arm, comprising support configured to support a drill string component and being swingable around a second swing axis between a loading position for drill string components and said delivering position, and a guiding beam comprising first and second ends opposite each other, wherein the first end is secured adjacent to the first swing axis, and wherein the second end is secured adjacent to the second swing axis, whereby the guiding beam is arranged to provide a mechanical stop for the gripper unit in said second position and to provide a mechanical stop for the swing arm in the delivering position.

2. The handling device according to claim 1, wherein the guiding beam is pivotally fastenable around a first pivot axis in connection with a region of the first swing axis.

3. The handling device according to claim 2, wherein the first pivot axis is at least essentially coaxial with the first swing axis.

4. The handling device according to claim 2 wherein the guiding beam is fastenable pivotally around a second pivot axis in connection with a region of the second swing axis.

5. The handling device according to claim 4, wherein the second pivot axis is at least essentially co-axial with the second swing axis.

6. The handling device according to claim 1, wherein in the first position, the gripper unit is positioned for engaging an end portion of a first drill string component and an end portion of a second drill string component.

7. The handling device according to claim 1, wherein in the second position, the gripper unit engages an end portion of a drill string component to place or remove the drill string component from said active drill string position.

8. The handling device according to claim 1, wherein at least one of the swing arm or the gripper unit in a respective distal position, opposite to a region of the respective swing axis, provides abutment elements for alignment contact with abutment means on the guiding beam in said delivering position.

9. The handling device according to claim 8, wherein at least one of said abutment elements and said abutment means is adjustable for adjustment of alignment position.

10. The handling device according to claim 1, wherein at least one of the swing arm or the guiding beam provides guiding elements for lateral alignment of the swing arm in the delivering position.

11. The handling device according to claim 1, wherein the guiding beam comprises a longitudinal guide and a gripper shuttle being drivingly moveable along the longitudinal guide, said gripping shuttle being provided with a pivotally arranged guiding gripper for guiding a first end region of a drill string component, another end region of the drill string component being arranged to be engaged with a lifting plug.

12. The handling device according to claim 1, wherein the swing arm and the gripper unit are swingable in a vertical plane or in a plane including an axis of the active drill string position or in a plane being parallel to such a plane.

13. A rock drill rig, comprising:

a drill string;

a rotator device for rotation and driving of the drill string and being moveable to and fro;

a feed beam configured to support the rotator device; and a handling device comprising:

a gripper unit for gripping drill string components to be placed or be removed in or from an active drill string position of the drill rig, wherein the gripper unit is swingably supported around a first swing axis in a region of the feed beam between:

a first position aligned with said active drill string position, and a second position aligned with a delivering position for drill string components to be placed or be removed in or from said active drill string position, a swing arm comprising support configured to support a drill string component and being swingable around a second swing axis between a loading position for drill string components and said delivering position, and a guiding beam comprising first and second ends disposed opposite each other, wherein the first end is secured adjacent to the first swing axis, and wherein the second end is secured adjacent to the second swing axis, whereby the guiding beam is arranged to provide a mechanical stop for the gripper unit in said second position and to provide a mechanical stop for the swing arm in the delivering position.

14. A method for handling drill string components with respect to a rock drill rig, the method comprising:

rotating and driving a drill string with a rotator device being supported moveably to and fro on a feed beam, gripping a drill string component to be placed or be removed in or from an active drill string position of the drill rig, swinging a gripper unit around a first swing axis in the region of the feed beam between:

a) a first position aligned with said active drill string position, and b) a second position aligned with a delivering position for drill string components to be placed or be removed in or from said active drill string position, swinging a swing arm comprising a support configured to support a drill string component around a second swing axis between a loading position for drill string components and said delivering position, and mechanically stopping the gripper unit in said second position and for as well as the swing arm in the delivering position, with a guiding beam comprising first and second ends being disposed opposite each other and respectively secured adjacent the respective first and second swing axis.

15. The method according to claim 14, wherein in the first position, the gripper unit engages an end portion of a first drill string component and an end portion of a second drill string component, and in the second position the gripper unit engages an end portion of a drill string component to place or remove the drill string component in or from said active drill string position.

16. The method according to claim 14, wherein at least one of the swing arm or the gripper unit abuts with the guiding beam in said delivering position.

17. The method according to claim 14, further comprising abutment elements on the swing arm and an abutment member on the gripper unit, wherein at least one of the abutment elements or the abutment member is adjusted for adjustment of alignment position.

18. The method according to claim 17, wherein at least one of the abutment elements or the abutment member are mutually guided for lateral alignment of the swing arm in the delivering position.

19. The method according to claim 14, wherein the swing arm and the gripper unit are swung in a vertical plane or in a plane including an axis of the active drill string position or in a plane being parallel to such a plane.

* * * * *